US009583321B2

(12) United States Patent
Silivra et al.

(10) Patent No.: US 9,583,321 B2
(45) Date of Patent: Feb. 28, 2017

(54) METHOD FOR MASS SPECTROMETER WITH ENHANCED SENSITIVITY TO PRODUCT IONS

(71) Applicant: Thermo Finnigan LLC, San Jose, CA (US)

(72) Inventors: Oleg Silivra, Milpitas, CA (US); Harald Oser, San Carlos, CA (US); Terry N. Olney, Tracy, CA (US)

(73) Assignee: Thermo Finnigan LLC, San Jose, CA (US)

( * ) Notice: Subject to any disclaimer, the term of this patent is extended or adjusted under 35 U.S.C. 154(b) by 80 days.

(21) Appl. No.: 14/138,589

(22) Filed: Dec. 23, 2013

(65) Prior Publication Data

US 2015/0179419 A1 Jun. 25, 2015

(51) Int. Cl.
*H01J 49/26* (2006.01)
*H01J 49/00* (2006.01)

(52) U.S. Cl.
CPC ..... *H01J 49/0031* (2013.01); *H01J 49/004* (2013.01); *H01J 49/0036* (2013.01)

(58) Field of Classification Search
CPC .. H01J 49/004; H01J 49/0045; H01J 49/0072; H01J 49/0095; H01J 49/40; H01J 49/401; H01J 49/403; H01J 49/405; H01J 49/406; H01J 49/408
USPC ..... 250/281, 282, 283, 286, 287
See application file for complete search history.

(56) References Cited

U.S. PATENT DOCUMENTS 4,234,791 A * 11/1980 Enke ..... H01J 49/4215 250/281
5,847,386 A 12/1998 Thomson et al.
6,177,668 B1 * 1/2001 Hager ..... H01J 49/004 250/281
6,683,301 B2 1/2004 Whitehouse et al.
6,891,153 B2 5/2005 Bateman et al.
7,675,031 B2 3/2010 Konicek et al.
8,637,816 B1 1/2014 Mordehai et al.
(Continued)

FOREIGN PATENT DOCUMENTS

EP 2380185 A1 7/2010
EP 2622628 A 4/2012
(Continued)

*Primary Examiner* — David E Smith
(74) *Attorney, Agent, or Firm* — Thomas F. Cooney

(57) ABSTRACT

A mass spectrometry method comprises: introducing a first portion of a sample of ions including precursor ions comprising a first precursor-ion mass-to-charge (m/z) ratio into a first mass analyzer; transmitting the precursor ions from the first mass analyzer to a reaction or fragmentation cell such that a first population of product ions are continuously accumulated therein over a first accumulation time duration; initiating release of the accumulated first population of product ions from the reaction or fragmentation cell; continuously transmitting the released first population of product ions from the reaction cell to a second mass analyzer; transmitting a portion of the released first population of product ions comprising a first product-ion m/z ratio from the second mass analyzer to a detector; and detecting a varying quantity of the product ions having the first product-ion m/z ratio for a predetermined data-acquisition time period after the initiation of the release.

9 Claims, 10 Drawing Sheets

(56) References Cited

U.S. PATENT DOCUMENTS

| | | | | |
|---|---|---|---|---|
| 8,658,970 | B2 | 2/2014 | Kenny | |
| 2003/0001085 | A1* | 1/2003 | Bateman | H01J 49/065 250/281 |
| 2005/0236578 | A1* | 10/2005 | Kawato | H01J 49/427 250/396 R |
| 2007/0057174 | A1 | 3/2007 | Hansen | |
| 2008/0017789 | A1* | 1/2008 | Hager | H01J 49/004 250/283 |
| 2008/0191130 | A1* | 8/2008 | Bateman | H01J 49/027 250/283 |
| 2009/0095898 | A1 | 4/2009 | Collings et al. | |
| 2009/0127453 | A1* | 5/2009 | Ding | H01J 49/0072 250/282 |
| 2009/0134321 | A1* | 5/2009 | Hoyes | C08L 23/04 250/282 |
| 2009/0266983 | A1* | 10/2009 | Yamamoto | H01J 49/0036 250/287 |
| 2010/0301227 | A1 | 12/2010 | Muntean | |
| 2011/0024619 | A1 | 2/2011 | Makarov | |
| 2011/0127419 | A1* | 6/2011 | Thomson | H01J 49/004 250/282 |
| 2011/0278450 | A1 | 11/2011 | Loucks, Jr. et al. | |
| 2012/0032074 | A1* | 2/2012 | Kenny | H01J 49/0031 250/283 |
| 2012/0205536 | A1 | 8/2012 | Itoi | |
| 2013/0015349 | A1 | 1/2013 | Steiner et al. | |
| 2013/0020481 | A1 | 1/2013 | Makarov et al. | |
| 2013/0206979 | A1* | 8/2013 | Bonner | H01J 49/0031 250/282 |
| 2013/0302334 | A1* | 11/2013 | Krizman | C07K 14/4747 424/135.1 |

FOREIGN PATENT DOCUMENTS

| | | | |
|---|---|---|---|
| WO | WO2006129083 | A2 | 12/2006 |
| WO | WO2013067366 | A2 | 5/2013 |
| WO | WO2013098599 | A1 | 7/2013 |

* cited by examiner

METHOD FOR MASS SPECTROMETER WITH ENHANCED SENSITIVITY TO PRODUCT IONS

FIELD OF THE INVENTION

This invention relates generally to mass spectrometry and mass spectrometers and, in particular, to tandem mass spectrometry methods and apparatus.

BACKGROUND OF THE INVENTION

The constant evolution of analytical instrumentation consists in achieving faster data acquisition and improved instrument sensitivity. In the field of mass spectrometry, structural elucidation of ionized molecules is often carried out using a tandem mass spectrometer, where a particular precursor ion is selected at the first stage of analysis or in the first mass analyzer (MS-1), the precursor ions are subjected to fragmentation (e.g. in a collision cell), and the resulting fragment (product) ions are transported for analysis in the second stage or second mass analyzer (MS-2). The method can be extended to provide fragmentation of a selected fragment, and so on, with analysis of the resulting fragments for each generation. This is typically referred to an $MS^n$ spectrometry, with n indicating the number of steps of mass analysis and the number of generations of ions. Accordingly, $MS^2$ corresponds to two stages of mass analysis with two generation of ions analyzed (precursor and products). As but one non-limiting example, tandem mass spectrometry is frequently employed to determine peptide amino acid sequences in biological samples. This information can then be used to identify peptides and proteins.

FIGS. 1A, 1B, 1C, 1D, 1E and 1F depict the components of a conventional mass spectrometer system 1. It will be understood that certain features and configurations of the mass spectrometer system 1 are presented by way of illustrative examples, and should not be construed as limiting the implementation of the present teachings in or to a specific environment. An ion source, which may take the form of an electrospray ion source 5, generates ions from an analyte material, for example the eluate from a liquid chromatograph (not depicted). The ions are transported from ion source chamber 10, which for an electrospray source will typically be held at or near atmospheric pressure, through several intermediate chambers 20, 25 and 30 of successively lower pressure, to a vacuum chamber 35 in which quadrupole mass filter (QMF) 51, an ion reaction cell 52 (such as a collision or fragmentation cell) and a mass analyzer 40 reside. Efficient transport of ions from ion source 5 to the vacuum chamber 35 is facilitated by a number of ion optic components, including quadrupole radio-frequency (RF) ion guides 45 and 50, octopole RF ion guide 55, skimmer 60, and electrostatic lenses 65 and 70. Ions may be transported between ion source chamber 10 and first intermediate chamber 20 through an ion transfer tube 75 that is heated to evaporate residual solvent and break up solvent-analyte clusters. Intermediate chambers 20, 25 and 30 and vacuum chamber 35 are evacuated by a suitable arrangement of pumps to maintain the pressures therein at the desired values. In one example, intermediate chamber 20 communicates with a port of a mechanical pump (not depicted), and intermediate pressure chambers 25 and 30 and vacuum chamber 35 communicate with corresponding ports of a multistage, multiport turbomolecular pump (also not depicted).

Electrodes 80 and 85 (which may take the form of conventional plate lenses) positioned axially outward from the mass analyzer 40 in the generation of a potential well for axial confinement of ions, and also to effect controlled gating of ions into the interior volume of the mass analyzer 40. The mass analyzer 40 is additionally provided with at least one detector that generates a signal representative of the abundance of ions that exit the mass analyzer, generally after been selected in the mass analyzer according to their mass-to-charge (m/z) ratio. If the mass analyzer 40 is provided as a quadrupole mass filter, then a detector at detector position 54 will generally be employed so as to receive and detect those ions which selectively completely pass through the mass analyzer 40 from an entrance end to an exit end. If alternatively, the mass analyzer 40 is provided as a linear ion trap that performs mass analysis by selective ejection of ions, then one or more detectors at detector positions 90 may be employed.

Ions enter an inlet end of the mass analyzer 40 as a continuous or quasi-continuous beam after first passing, in the illustrated conventional apparatus, through a quadrupole mass filter (QMF) 51 and an ion reaction cell 52. The QMF 51 may take the form of a conventional multipole structure operable to selectively transmit ions within an m/z range determined by the applied RF and DC voltages. The collision cell 52 may also be constructed as a conventional multipole structure to which an RF voltage is applied to provide radial confinement. The interior of the collision cell 52 is pressurized with a suitable collision gas, and the kinetic energies of ions entering the collision cell 52 may be regulated by adjusting DC offset voltages applied to QMF 51, collision cell 52 and tens 53.

The mass spectrometer system 1 shown in FIG. 1A may operate as a conventional triple quadrupole mass spectrometer, wherein ions are selectively transmitted by QMF 51, fragmented in the ion reaction cell 52, and wherein the resultant product ions are mass analyzed so as to generate a product-ion mass spectrum by mass analyzer 40 and one of the detectors 54, 90. Samples may be analyzed using standard techniques employed in triple quadrupole mass spectrometry, such as precursor ion scanning, product ion scanning, single- or multiple reaction monitoring, and neutral loss monitoring, by applying (either in a fixed or temporally scanned manner) appropriately tuned RF and DC voltages to QMF 51 and mass analyzer 40. The operation of the various components of the mass spectrometer systems may be directed by a control and data system 44, which will typically consist of a combination of general-purpose and specialized processors, application-specific circuitry, and software and firmware instructions. The control and data system 44 may also provide data acquisition and post-acquisition data processing services.

FIG. 1B is a more-detailed depiction of the ion reaction cell 52 and showing the electrodes 53 and 80. As illustrated, the ion reaction cell comprises a multipole device specifically a quadrupole comprising four elongated and substantially parallel rod electrodes arranged as a pair of first rod electrodes 56 and a pair of second rod electrodes 46. The leftmost diagram of FIG. 1B provides a longitudinal view and the rightmost diagram provides a transverse cross-sectional view, respectively, of the ion reaction cell 52. Note that only one of the rod electrodes 46 is shown, since the view of the second rod electrode 46 is blocked. The four rod electrodes define an axis 59 of the device that is, parallel to the rod electrodes 46, 56 and that is centrally located between the rod electrodes; in other words, the four rod electrodes 46, 56 are equidistantly radially disposed about the axis 59. Although the reaction cell 53 is shown with four rods so as to generate a quadrupolar electric field, the reaction cell may alternatively comprise six (6) rods, eight (8) rods, or even more rods so as to generate a hexapotar, octopolar, or higher-order electric field respectively. The rod electrodes may be contained within a housing 57 which serves to contain a collision gas used for collision induced dissociation of precursor ions introduced into a trapping volume between the rod electrodes 46, 56 through an entrance end 58*a*.

FIG. 1C schematically illustrates typical basic electrical connections for the rod electrodes 46, 56. RF modulated potentials provided by power supply 250 are applied to points A and B, which are electrically connected to electrodes 46 and electrodes 56, respectively. The electrode of each pair of electrodes—that is, the pair of electrodes 46 and the pair of electrodes 56—are diametrically opposed to one another with respect to the ion occupation volume longitudinal axis 59. The phase of the RF voltage applied to one of the pairs of electrodes is always exactly out of phase with the phase applied to the other pair of electrodes. Optionally, the power supply 250 may provide a DC offset potential such that point A is maintained at a first DC potential and such that point B is maintained at either the first DC potential or at a second DC potential. Accordingly, in some embodiments, a DC potential difference may exist between the first pair 56 and the second pair 46 of rod electrodes.

In known fashion, application of RF potentials to the rod electrodes 46, 56 as discussed above produces an electric field pseudo-potential well about and in close proximity to the central axis 59. In operation, ion lenses or electrodes, such as entrance electrode 53 and others (not shown) are used to propel ions into the entrance end 58*a* (FIG. 1B) of the multipolar rod set (e.g., rod electrodes 46, 56) defined by a set of first ends of the plurality of rods. The presence of the pseudo-potential well causes the ions to remain in an ion trapping volume in the vicinity of the axis 59 as these ions progress through the reaction cell from the entrance end 58*a* to an exit end 58*b* of the multipolar rod set.

The ion trapping volume does not have sharp boundaries that can be precisely located. In any event, however, the true trapping volume lies within the region 12 denoted by lines connecting the innermost points of the four rod electrodes. Thus the region 12 can be considered to comprise a practical trapping volume that is defined by the electrodes themselves such that the true trapping volume resides within the practical trapping volume 12. Both the practical trapping volume and the true trapping volume are elongated parallel to the axis 59 between the entrance end 58*a* and the exit end 58*b*. The entrance and exit ends 58*a*, 58*b* are defined by the ends of the rod electrodes 46, 56. The ion trapping produced by the application of the RF field is effective in directions that are radial to the axis 59 (that, is within transverse cross-sectional planes such as the one illustrated on the right-hand side of FIG. 1B). In most conventional operation of collision or reaction cells, the ions are not trapped parallel to or along the axis 59.

Although the reaction cell 52 shown in FIG. 1B is illustrated with straight, parallel rod electrodes, alternative reaction cell configurations are known in which the electrodes are curved. For example, the reaction cell 62 shown in FIG. 1D comprises a pair of first elongated electrodes 66 and a pair of second elongated electrodes 76, each of which comprises an arc segment such as a segment of a circular ring. Only one of the electrodes 76 is illustrated, since the second such electrode is behind the illustrated electrode 76 and therefore hidden from view. Alternatively, six, eight or some other number of electrodes could be employed. Alternatively, the curved elongated electrodes need not be in the form of circular arcs and may be formed, for example, with elliptical or parabolic curvature.

In operation, radio frequency (RF) and optional DC voltages are applied to the electrodes 66 and 76 as previously described (see FIG. 1B) and, consequently, ions propagating through the device 62, after introduction into the device at entrance end 68*a*, tend to follow the path of a curved axis 59 through the device from the entrance end 68*a* to an exit end 68*b*, with the axis 59 being defined centrally with respect to the set of curved electrodes. For the illustrated reaction cell 62, the curved central axis may be considered to be co-extensive with an arc of a circular section having a radius of curvature. The curved reaction cell provides an elongate ion trapping volume that closely follows the curved axis 59 between the entrance end 68*a* and the exit end 68*b*. Similarly an elongate operational trapping volume that contains the true trapping volume may be defined with reference to the curved rod electrodes 66 and 76 in a fashion similar to that described previously.

Curved reaction cells such as the reaction cell 62 shown in FIG. 1D enable the folding or turning of ion paths and allow smaller "footprints" than would otherwise be required for straight reaction cells (e.g., FIG. 1B). However, they are associated with a potential disadvantage in that ions having high kinetic energy may fly out of the vicinity of the curved axis and consequently develop unstable trajectories which will cause them to be ejected from the device or else contact the electrodes. As one means to address this issue, U.S Patent Application Pre-Grant Publication No. 2009/0095898 A1, in the names of inventors Collings et al., describes collision cells that include both curved sections and straight sections, the straight sections being of lengths selected in order to allow precursor ions to lose enough kinetic energy, as they pass through the straight sections, to allow the precursor ions to travel through the curved sections without either escaping the collision cell or colliding with the collision cell electrodes. Alternatively, U.S Patent Application Pre-Grant Publication No. 2010/0301227 A1, in the name of inventor Muntean, describes ion guides, including collision cells, having ion deflecting devices that are configured for applying a radial DC electric field across the ion guide region at a magnitude that varies along the curved central axis.

In some instances, the elevated collision gas pressure within a collision cell can cause product ions that have been formed in the collision cell to drain out of the cell slowly or possibly even stall within the collision cell as a result of their very low velocity after many collisions with neutral gas molecules. The resulting lengthened ion clear-out time can cause interference between adjacent channels when several ion pairs (i.e., parent/products) are being measured in rapid succession. U.S. Pat. No. 5,847,386, in the names of inventors Thomson et al., describes several apparatus configurations that are designed to reduce this problem through the provision of an electric field that is parallel to the device axis within the space between the elongated electrodes. For example, the aforementioned patent teaches that this axial field can be created by tapering the rods, or arranging the rods at angles with respect to each other. In one apparatus example that includes elongated rod electrodes that are tapered along their length, the rods of one pair (e.g., either rods 46 or 56 as shown in FIG. 1B) is oriented so that the wide ends of the rods are at the entrance end 58*a* and the narrow ends are at the exit end 58*b* of the rod set and the other pair is oriented so that its wide ends are at the exit end 58*b* and so that its narrow ends are at the entrance end 58*a*. The provision of a first DC offset voltage on one of the tapered rod pairs and a second DC offset voltage on the other tapered rod pair (see FIG. 1C) then causes the axial field to be formed within the interior volume between the rods.

Another apparatus configuration described in the aforementioned U.S. Pat. No. 5,847,386 includes segmented rods, wherein different DC offset voltages are applied to each respective segment such that ions within the interior volume experience a stepped DC electrical potential in a direction from the entrance end to the exit end. For example, FIG. 1E illustrates a collision cell or reaction cell 152 in which the rods 46 and the rods 56 (as shown in and previously described in reference to FIG. 1B) are replaced by series of rod segments 146 and 156, respectively. Each segment 146 is supplied with the same RF voltage and each segment 156 is supplied with the same phase-shifted RF voltage from power supply 250 via a set of isolating capacitors (not illustrated), but each is supplied with a different DC voltage.

U.S. Pat. No. 7,675,031, in the names of inventors Konicek et al. and assigned to the assignee of the present invention, describes an alternative apparatus configuration to address the problem of slowed ion movement through a collision cell. This latter patent teaches the use of auxiliary electrodes for creating drag fields within the cell interior volume. The auxiliary electrodes may be provided as arrays of finger electrodes for insertion between main RF electrodes (e.g., the rod electrodes 46, 56 shown in FIG. 1B or the rod electrodes 66, 76 shown in FIG. 1D) of a multipole device. The finger electrodes may be provided on thin substrate material such as printed circuit board material. A progressive range of voltages can be applied along lengths of the auxiliary electrodes by implementing a voltage divider that utilizes static resisters interconnecting individual finger electrodes of the arrays. Dynamic voltage variations may be applied to individual finger electrodes or to groups of the linger electrodes.

FIG. 1F shows a simplified depiction of one exemplary configuration taught in U.S. Pat. No. 7,675,031. The leftmost view of FIG. 1F is a longitudinal view of the apparatus 252 showing, very schematically, the disposition of auxiliary electrodes 77, which may be configured with one or more terminal finger electrodes, between the main rod electrodes 46, 56, wherein these rod electrodes are as shown in FIG. 1B. The rightmost view of FIG. 1F is a transverse cross-sectional view which more accurately show how the auxiliary electrodes 77 are disposed between adjacent pairs of the main rod electrodes. The auxiliary electrodes can occupy positions that generally define planes that, if extended, intersect on the central axis 59. These planes can be positioned between adjacent RF rod electrodes at about equal distances from the main RF electrodes of the multipole ion guide device where the quadrupolar fields are substantially zero or close to zero, for example. Thus, the configured arrays of finger electrodes 71 can lie generally in these planes of zero potential or close to zero potential so as to minimize interference with the quadrupolar fields. The array of auxiliary electrodes and finger electrodes can also be adapted for use with curved quadrupolar configurations such as the configuration shown in FIG. 1D.

Mass spectrometers which utilize the measurements of ion current (triple quadrupole mass spectrometers for example) have a sensitivity limit defined by the minimum current which the mass spectrometer detector can dependably distinguish from background signal and random "noise". This fact limits the lowest analyte abundance which can be reliably detected in such systems. Although mass spectrometers that measure induced image currents (such as Fourier-Transform Ion Cyclotron Resonance and orbital trap mass spectrometers) offer greater sensitivity, the ion-current-detecting types of systems are in widespread use. Unfortunately, many diagnostic analyte compounds are present at low concentrations in natural samples. This problem may be exacerbated during tandem mass spectrometry measurements since any particular precursor ion type will generally give rise to a variety of product ion types and, thus, any product ion type will be present at a lower abundance than that of the precursor ion from which it was generated. Moreover, some quantity of ions is invariably lost during each of the various ion manipulation steps associated with tandem mass spectra measurements. These factors significantly limits the application of the aforementioned ion-current-detecting instruments applications in which analytes of interest are present at low and therefore potentially undetectable concentrations. Thus, there is a need in the art for methods and systems that can enable such systems to make reliable detection and quantification measurements of low-abundance product ions generated in tandem mass spectrometry.

SUMMARY OF THE INVENTION

To address the above-identified needs in the art, the inventors have developed, tested and characterized a new method of performing tandem mass spectrometry, here termed the method of reaction product accumulation. The main advantage of this novel method is that it allows the detection of reaction product ions present in quantities which may be hundreds times below quantities defined as limits of detection for instruments not benefiting from the new method. In other words, the new method increases instrument sensitivity by said number of times and allows for the detection of ions which otherwise would be not registered by the identical mass spectrometer not benefiting from the method. Especially, those mass spectrometers that utilize a continuous ion beam generated in an ion source and that employ a dedicated dissociation cell, such as the widely-used triple quadrupole mass spectrometers, can benefit from the new method.

The new method works on the principle of charge accumulation: the product of acquisition time and enhanced signal is proportional to the product of accumulation time and equilibrium state signal. Typically, ion reaction cells, such as ion fragmentation cells that fragment ions through collision-induced dissociation, operate on a continuous input beam of precursor ions which are reacted during their passage through the reaction cell so as to generate an equilibrium-state output of product ions. The inventors have however realized that an enhanced product ion signal can be generated by temporarily accumulating the product ions in the reaction cell. The length of accumulation time can be adjusted in order to bring the intensity of an ion of interest to the value necessary for dependable detection. Such ions include, but are not limited to, products of Multiple/Selected Reaction Monitoring (MRM/SRM) or Neutral Loss reactions. Signal improvement is achieved by the accumulation of product ions in the reaction cell during interscan times or during specifically created accumulation events followed by subsequent passing of the accumulated reaction product or products of interest to the detection system.

Accordingly, a first method for operating a mass spectrometer in accordance with the present teachings comprises: (a) introducing a first portion of a sample of ions into a first mass analyzer of the mass spectrometer, the sample including precursor ions comprising a first precursor-ion mass-to-charge (m/z) ratio; (b) transmitting the precursor ions comprising the first precursor-ion m/z ratio from the first mass analyzer into a reaction or fragmentation cell of the mass spectrometer through an entrance end thereof such that a first population of product ions generated within the fragmentation or reaction cell from the precursor ions are continuously accumulated within an elongate trapping volume thereof over a first accumulation time period; (c) initiating release of the accumulated first population of product ions from the reaction or fragmentation cell through an exit end thereof, wherein the entrance and exit ends are disposed at opposite ends of the elongate trapping volume; (d) continuously transmitting the released first population of product ions from the reaction cell to a second mass analyzer of the mass spectrometer; (e) transmitting a portion of the released first population of product ions from the second mass analyzer to a detector of the mass spectrometer, said portion comprising a first product-ion m/z ratio; and (f) detecting a varying quantity of the portion of the released first population of product ions having the first product-ion in/z ratio with the detector for a predetermined data-acquisition time period after the initiation of the release of the accumulated first population of product ions.

In some embodiments, the transmitting of the precursor ions comprising the first precursor-ion m/z ratio from the first mass analyzer to the reaction or fragmentation cell comprises continuously transmitting the precursor ions comprising the first precursor-ion m/z ratio from a quadrupole mass filter to the reaction or fragmentation cell. In some embodiments the transmitting of the portion of the released first population of product ions from the second mass analyzer to the detector comprises continuously transmitting the portion of the released first population of product ions from a quadrupole mass filter to the detector. In some embodiments, the reaction or fragmentation cell is a quadrupole reaction or fragmentation cell and in some embodiments, the mass spectrometer is a triple quadrupole mass spectrometer.

The step of detecting the varying quantity of the portion of the released first population of product ions with the detector for the predetermined data-acquisition time period may comprise detecting the varying quantity of the portion of the released first population of product ions with the detector for a time period having a duration of less than or equal to five milliseconds. In some embodiments, this step may comprise detecting the varying quantity of the portion of the released first population of product ions with the detector for a time period having a duration of less than or equal to one millisecond. In various embodiments, the predetermined data-acquisition time period may be chosen so as to encompass a time during which a rate of destruction of product ions comprising the first product-ion m/z ratio within the reaction or fragmentation cell is equal to the rate of generation of the product ions comprising the first product-ion m/z ratio within the reaction or fragmentation cell. After detecting (or even during the detecting of) the varying quantity for the predetermined data-acquisition time period the detected quantity may be mathematically summed or integrated over time so as to yield a single integrated quantity that is, a single numerical value. The single integrated quantity determined in this fashion will generally be proportional to or indicative of the total number of product ions detected in step (f) during the predetermined data-acquisition time period. If this quantity is significantly greater than zero, it may be used to positively determine the presence in the sample of an analyte compound that gave rise, through ionization, to the precursor ions comprising the first precursor-ion m/z ratio and that, indirectly, gave rise to the product ions comprising the first product-ion in/z ratio. The single integrated quantity may also be used to calculate a concentration or quantitative amount of the analyte compound within the sample.

The first method for operating a mass spectrometer described above may be extended by the following additional steps: (a2) introducing a second portion of the sample of ions into the first mass analyzer, said second portion including additional precursor ions comprising the first precursor-ion m/z ratio; (b2) transmitting the additional precursor ions comprising the first precursor-ion m/z ratio from the first mass analyzer into the reaction or fragmentation cell through the entrance end such that a second population of product ions generated within the fragmentation or reaction cell from the additional precursor ions are continuously accumulated within the elongate trapping volume over a second accumulation time period; (c2) initiating release of the accumulated second population of product ions from the reaction or fragmentation cell through the exit end; (d2) continuously transmitting the released second population of product ions from the reaction cell to the second mass analyzer; (e2) transmitting a portion of the released second population of product ions from the second mass analyzer to the detector, said portion comprising the first product-ion m/z ratio; (f2) detecting a varying quantity of the portion of the released second population of product ions having the first product-ion m/z ratio with the detector for the predetermined data-acquisition time period after the initiation of the release of the accumulated second population of product ions; and adding together or averaging the detected varying quantities of the portion of the released first and second populations of product ions. The sum of the detected quantities may be mathematically summed or integrated over time so as to yield a single integrated quantity. The single integrated quantity, if significantly greater than zero, may be used to positively determine the presence in the sample of an analyte compound that gave rise, through ionization, to the precursor ions comprising the first precursor-ion m/z ratio and that, indirectly, gave rise to the product ions comprising the first product-ion m/z ratio. The single integrated quantity may also be used to calculate a concentration or quantitative amount of the analyte compound within the sample.

Advantageously, the steps of (a2) introducing the second portion of the sample of ions into the first mass analyzer and (b2) transmitting the additional precursor ions comprising the first precursor-ion m/z ratio from the first mass analyzer into the reaction or fragmentation cell may be initiated early in the sequence—that is, while one or more of the steps (d), (e) or (f) are being performed. The reason for this is that the data acquisition steps (d), (e) and (f) require only one or a few milliseconds of time, whereas the ion introduction, fragmentation and accumulation steps (a) and (b) or (a2) and (b2) will typically be much longer—100 ms or greater. Accordingly, subsequent batches of precursor ions may be introduced and fragmented, and the product ions accumulated, while the prior batch of product ions is being analyzed and detected.

In various embodiments, the first method for operating a mass spectrometer described above may be extended by the following steps: (g1) removing ions from the reaction or fragmentation cell; (a2) introducing a second portion of the sample of ions into the first mass analyzer; (b2) transmitting the second precursor ions comprising the second precursor-ion m/z ratio from the first mass analyzer into the reaction or fragmentation cell through the entrance end such that a second population of product ions generated within the fragmentation or reaction cell from the second precursor ions are continuously accumulated within the elongate trapping volume over a second accumulation time period; (c2) initiating release of the accumulated second population of product ions from the reaction or fragmentation cell through the exit end; (d2) continuously transmitting the released second population of product ions from the reaction cell to the second mass analyzer; (e2) transmitting a portion of the released second population of product ions from the second mass analyzer to the detector, said portion comprising a second product-ion m/z ratio; and (f2) detecting a varying quantity of the portion of the released second population of product ions having the second product-ion m/z ratio with the detector for a second predetermined data-acquisition time period after the initiation of the release of the accumulated second population of product ions.

The above steps may be iterated any number of times. Each iteration may comprise a step of removing any stray or remaining ions from the fragmentation or reaction cell followed by execution of the set of steps (a) through (f), as outlined above, in regard to a different portion or sample of ions. Thus, the following steps may be executed at the $N^{th}$ iteration: (step g(N−1)) removal of ions from the reaction or fragmentation cell; (step aN) introduction of an $N^{th}$ portion of the sample of ions into the first mass analyzer; (step bN) transmission of the $N^{th}$ precursor ions comprising the $K^{th}$ precursor-ion m/z ratio (where $K \leq N$) from the first mass analyzer into the reaction or fragmentation cell through the entrance end such that an $N^{th}$ population of product ions generated within the fragmentation or reaction cell from the precursor ions are continuously accumulated within the elongate trapping volume over an $N^{th}$ accumulated time period; (step cN) initiation of the release of the accumulated $N^{th}$ population of product ions from the reaction or fragmentation cell through the exit end; (step dN) continuous transmission of the released $N^{th}$ population of product ions from the reaction cell to the second mass analyzer; (step eN) transmission of a portion of the released $N^{th}$ population of product ions from the second mass analyzer to the detector, said portion comprising an $L^{th}$ product-ion m/z ratio; and (step fN) detecting a varying quantity of the portion of the released $N^{th}$ population of product ions having the product-ion m/z ratio (where $L \leq N$) with the detector for an $N^{th}$ predetermined data-acquisition time period after the initiation of the release of the accumulated $N^{th}$ population of product ions; where N, K and L can be the same or different integers.

In other embodiments, two or more different precursor ion types having different respective m/z ratios may be simultaneously reacted or fragmented in the reaction or fragmentation cell. In such cases, each precursor ion type will generally give rise to a different respective set of product ions. In such cases, a different respective product ion will be detected and monitored in conjunction with each precursor ion type. In some embodiments, a first precursor-ion type and product-ion type pair is selected for determining an amount of an analyte of interest and a second precursor-ion type and product-ion type is selected to monitor simultaneous injection of (or presence of) an isotopically labeled internal standard. A known quantity of the internal standard which may be chemically and structurally identical to the targeted analyte of interest except for the isotopic labeling may be mixed with the sample or separately infused into the mass spectrometer. The detection of the internal standard may then be used to correct or calibrate a calculated quantity of the analyte compound.

Accordingly, another method for operating a mass spectrometer in accordance with the present teachings comprises: (a) introducing a first portion of a sample of ions into a first mass analyzer of the mass spectrometer, the sample including precursor ions comprising a first precursor-ion mass-to-charge (m/z) ratio and precursor ions comprising a second precursor-ion in/z ratio; (b) transmitting the precursor ions comprising the first and second precursor-ion m/z ratios from the first mass analyzer into a reaction or fragmentation cell of the mass spectrometer through an entrance end thereof such that a population of product ions generated within the fragmentation or reaction cell from the precursor ions are continuously accumulated within an elongate trapping volume thereof over a first accumulation time period; (c) initiating release of the accumulated population of product ions from the reaction or fragmentation cell through an exit end thereof, wherein the entrance and exit ends are disposed at opposite ends of the elongate trapping volume; (d) continuously transmitting the released first population of product ions from the reaction cell to a second mass analyzer of the mass spectrometer; (e) transmitting a portion of the released first population of product ions from the second mass analyzer to a detector of the mass spectrometer, said portion comprising product ions comprising a first product-ion m/z ratio and product ions comprising a second product-ion m/z ratio generated, respectively, from the precursor ions comprising the first precursor-ion m/z ratio and the precursor ions comprising the second precursor-ion m/Z ratio; and (f) detecting a varying quantity of the product ions comprising the first product-ion m/z ratio and a varying quantity of the product ions comprising the second product-ion m/z ratio with the detector for a predetermined data-acquisition time period after the initiation of the release of the accumulated population of product ions. Prior to being transmitted (step b above) from the first mass analyzer into the reaction or fragmentation cell, the precursor ions comprising the first and second precursor-ion m/z ratios (and, possibly, additional ion types) may be simultaneously concentrated or purified in the first mass analyzer if the first mass analyzer is an ion trap mass analyzer. The simultaneous concentration or purification of these two or more ion types may be accomplished by operating the ion trap such that any and all ions having any other in/z ratios are ejected from the ion trap.

The steps (a)-(f) listed in the immediately preceding paragraph may be iterated. In such cases, the varying quantity of the product ions comprising the first product-ion m/Z ratio will be detected for a plurality, N, of times and the varying quantity of the product ions comprising the second product-ion m/z ratio will likewise be detected for a plurality, of times. If the detected data representing the varying quantities of these two ion types is not spectrometrically resolved, than a mathematical decomposition or deconvolution routine may be applied, in known fashion, so as to extract the information relating to the separately varying quantities of the two ion types. The N instances (each such instance being a function of time) of the detection of the varying quantity of the product ions comprising the first product-ion m/z ratio may be pointwise summed or averaged. Likewise, the N instances of the detection of the varying quantity of the product ions comprising the second product-ion m/z ratio may be pointwise summed or averaged. Further, each of the N instances of either of these ion types may be mathematically summed or integrated over time so as to yield, at each iteration, a time-integrated quantity. The resulting N instances of the time-integrated quantity may then be summed or averaged so as to yield a single integrated quantity. (Alternatively, the function representing the pointwise sum or average of the N instances may be summed or integrated over time so as to yield the single integrated quantity.) Any of these statements may be readily generalized to more than two precursor-ion types or product-ion types.

The single integrated quantity relating to the product ions comprising the first product-ion m/z ratio may, if significantly greater than zero, be used to positively determine the presence in the sample of an analyte compound that gave rise, through ionization, to the precursor ions comprising the first precursor-ion m/z ratio (and, indirectly, to the product ions comprising the first product-ion m/z ratio). Likewise, the single integrated quantity relating to the product ions comprising the second product-ion m/z ratio may, if significantly greater than zero, be used to positively determine the presence in the sample of an analyte compound that gave rise, through ionization, to the precursor ions comprising the second precursor-ion m/z ratio (and, indirectly, to the product ions comprising the second product-ion m/z ratio). Further, the respective single integrated quantity pertaining to either of the two ion types may also be used to calculate a concentration or quantitative amount of the respective corresponding analyte compound within the sample. Any of these statements may be readily generalized to more than two precursor-ion types, product-ion types or analyte compounds.

In some experimental situations, more than one ion transition may be monitored in conjunction with the detection or quantification of a single analyte. In other words, product ions comprising at least a first product-ion m/z ratio and a second product-ion m/z ratio are detected, wherein each product-ion type comprising a respective product-ion m/z ratio is generated by reaction or fragmentation of a respective precursor-ion comprising a respective precursor-ion m/z ratio and wherein all said precursor ion types are generated by ionization of a single analyte. Each monitored transition can serve as a redundancy check on the accuracy of other monitored transitions.

BRIEF DESCRIPTION OF THE DRAWINGS

The above noted and various other aspects of the present invention will become apparent from the following description which is given by way of example only and with reference to the accompanying drawings, not drawn to scale, in which:

FIG. 3 is a set of plots of results of experimental monitoring of the 182.1→119.1 ion transition of Polytyrosin 1,3,6 Obtained using a method in accordance with the present teachings, where

FIG. 4 is a set of plots of results of experimental monitoring of the 997.3→445.3 ion transition of Polytyrosin 1,3,6 Obtained using a method in accordance with the present teachings, where

FIG. 6 is a pair of plots of experimental results obtained using the method of FIG. 5, where

FIG. 7 is a set of plots of results of experimental monitoring of the 309.2→281.1 ion transition of a 2 μL/min infusion of a 100 fg/pt solution of alprazolam, the results obtained using a method in accordance with the present teachings, where FIG. 8 is a set of plots of results of experimental monitoring of the 309.2→281.1 ion transition of a 2 μL/min infusion of an 0.3 fg/μL solution of alprazolam, the results obtained using a method in accordance with the present teachings, where

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended FIGS. 1-8, taken in conjunction with the following description.

Figure 1A:
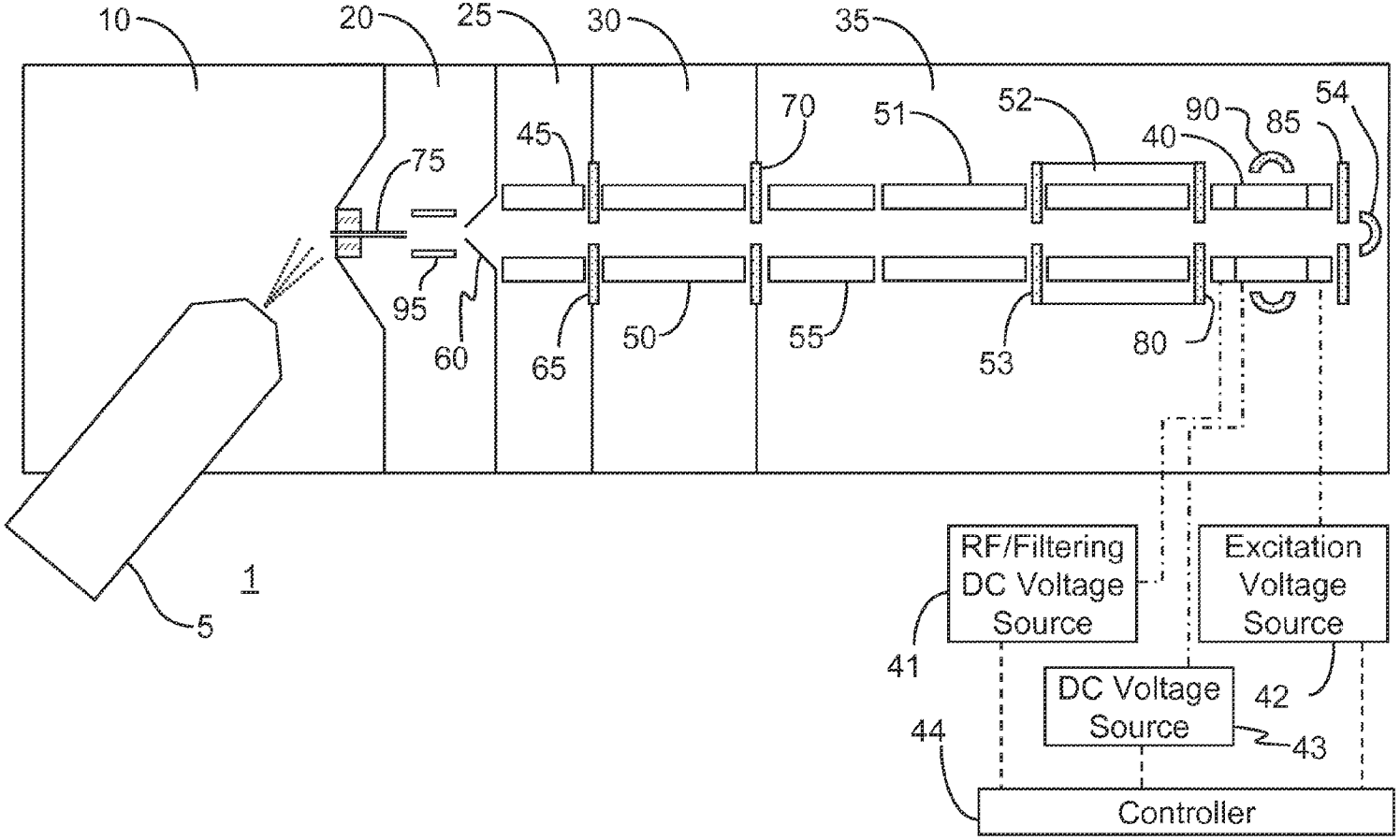
FIG. 1A (Prior Art)
FIG. 1A is a schematic diagram showing components of a conventional mass spectrometer system.
Figure 1B:
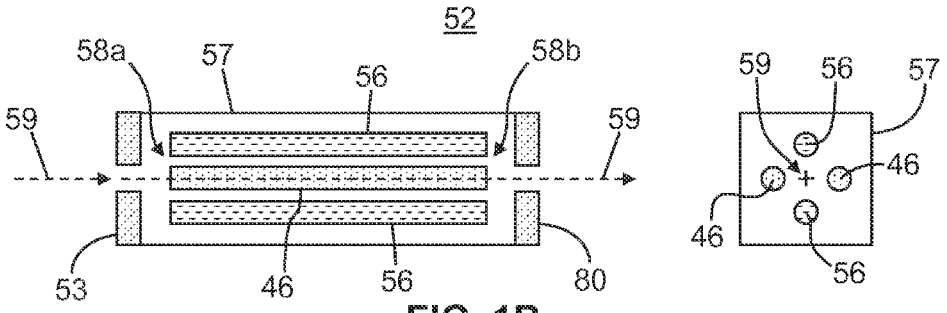
FIG. 1B (Prior Art)
FIG. 1B is a schematic illustration of a conventional quadrupolar collision or reaction cell as may be employed in the conventional mass spectrometer system of FIG. 1A.
Figure 1C:
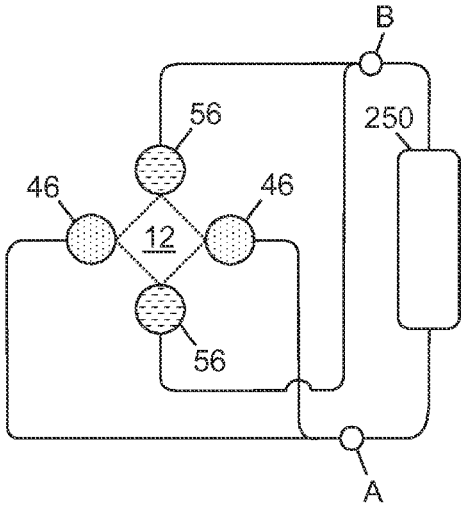
FIG. 1C (Prior Art)
FIG. 1C is a schematic diagram of typical electrical connections for a quadrupolar collision cell or reaction cell.
Figure 1D:
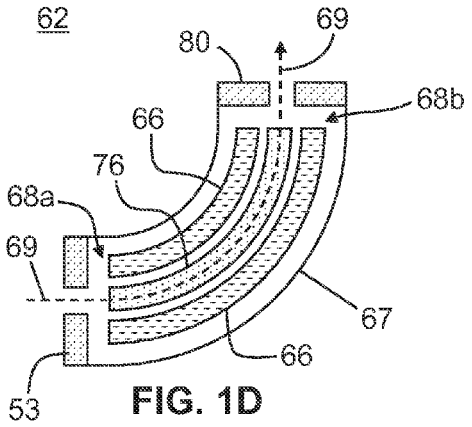
FIG. 1D (Prior Art)
FIG. 1D is a schematic illustration of a known curved quadrupolar collision or reaction cell as may be employed in the conventional mass spectrometer system of FIG. 1A.
Figure 1E:
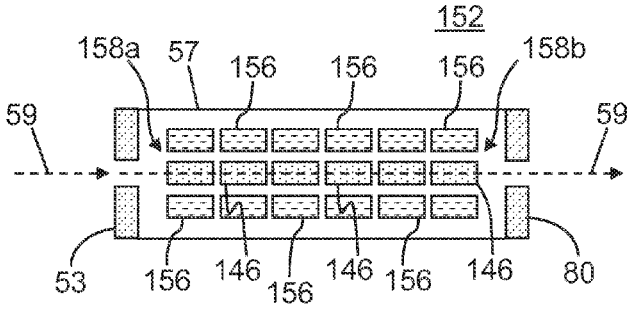
FIG. 1E (Prior Art)
FIG. 1E is a schematic illustration of a known segmented quadrupolar collision or reaction cell as may be employed in the conventional mass spectrometer system of FIG. 1A.
Figure 1F:
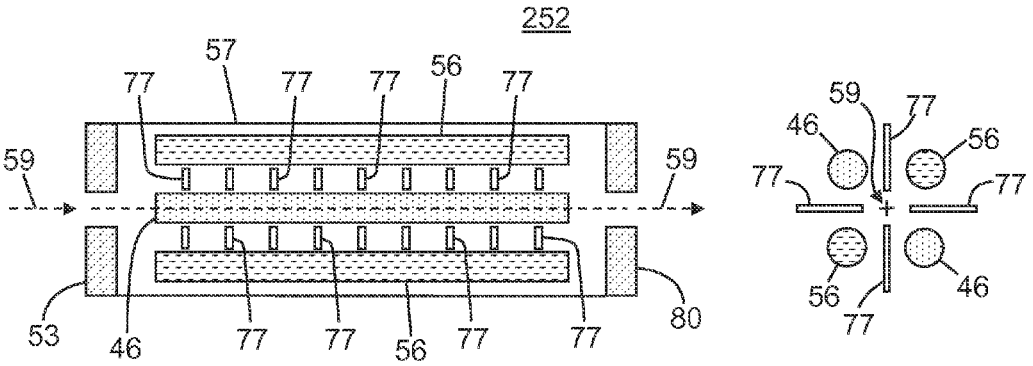
FIG. 1F (Prior Art)
FIG. 1F is a schematic illustration of a known alternative quadrupolar collision or reaction cell that includes auxiliary electrodes and that may be employed in the conventional mass spectrometer system of FIG. 1A.
Figure 2:
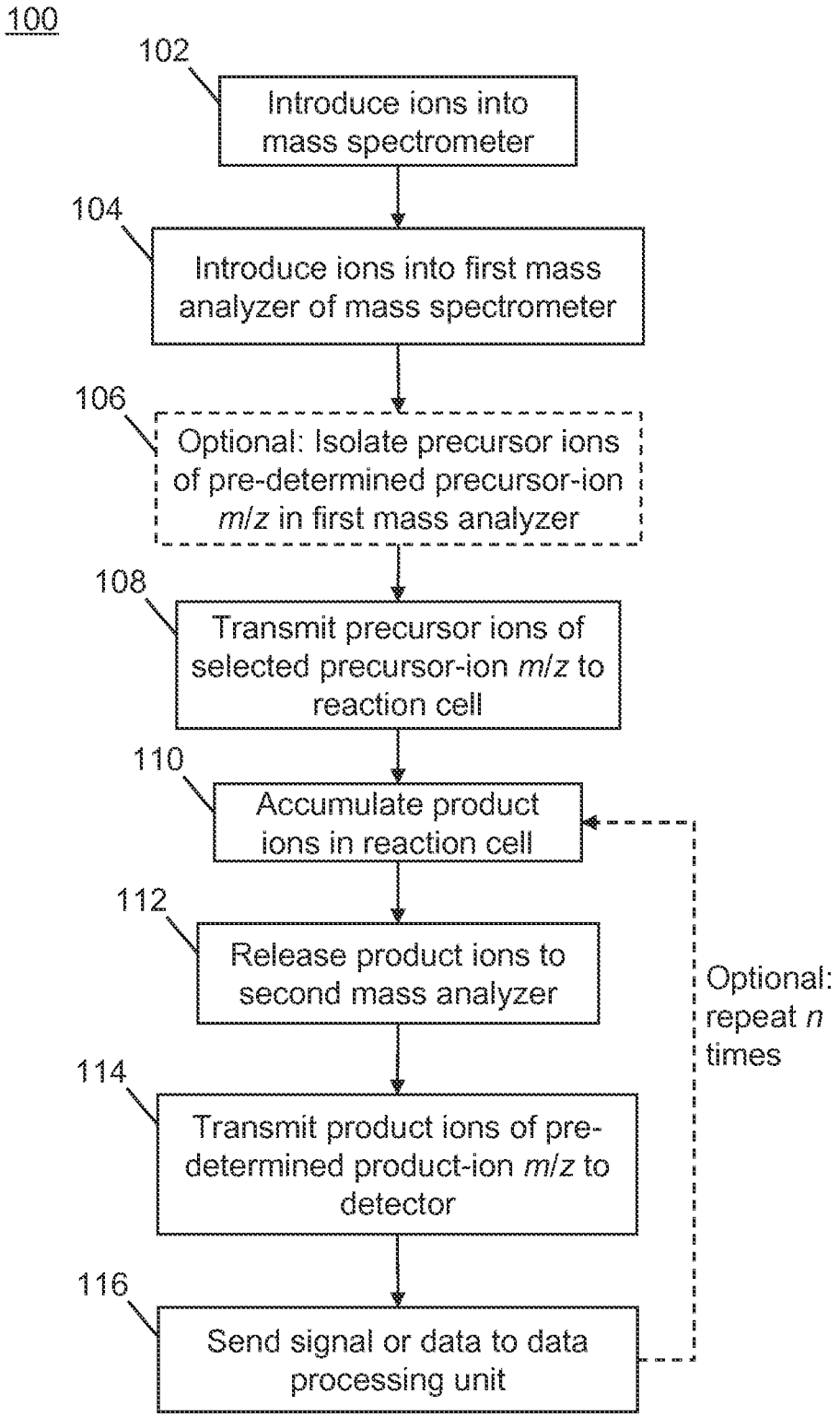
FIG. 2 is a flow diagram of a first method in accordance with the present teachings.

A flow diagram of a basic method in accordance with the present teachings is given in FIG. 2. The method 100 illustrated in FIG. 2 pertains to the analytical technique known as "selected reaction monitoring" (SRM) in which, from a sample of various ion types comprising a range of m/z ratios, a particular restricted m/z ratio range (a particular precursor-ion type) is selected and isolated and passed to a fragmentation cell. In the SRM technique, the selected and isolated precursor ions are fragmented in the fragmentation cell, so as to generally produce a range of product ion types comprising a range of product-ion m/z ratios. Then, from the various product-ion types, a particular restricted product ion in/z ratio range (a particular product-ion type) is selected for detection. As used in the following discussion, the notation $m_1 \rightarrow m_2$, where $m_1$ and $m_2$ are different mass-to-charge values, refers to an experiment in which the fragment or product ion having the mass-to-charge ratio of $m_2$ is detected or measured after its generation by fragmentation or other reaction of a selected precursor ion having the mass-to-charge ratio of $m_1$. The results of such experiments are often referred to as the measurement of the "transition" $m_1 \rightarrow m_2$.

A flow diagram of a method in accordance with the principles of the present teachings is shown in FIG. 2 is as method 100. Briefly, the steps are as follows. Sample ions are introduced (Step 102) into a mass spectrometer at an approximately constant rate, as might be provided, for example, from an electrospray ion source. Mass spectrometer instruments that process a steady stream of input ions in such a fashion are commonly known as beam instruments. For purposes of this discussion, the time during which the rate of ion introduction should be approximately constant is roughly the time within which product ions are accumulated in accordance with the method—roughly, in a range from hundreds of microseconds to several hundred milliseconds general, the rate of ion introduction may be expected to vary on longer time scales, especially if a chemical compound separation technique such as chromatography is employed prior to the generation of ions. However, on the shorter time scales of less than several hundred milliseconds, the rate of ion introduction can usually be regarded as approximately constant.

Through the front optics (e.g., ion guides 45, 50, and 55 in FIG. 1A), the sample ions are input (Step 104) to a first mass analyzer (e.g., QMF 51). If the first mass analyzer is a quadrupole mass filter, then this mass filter may be tuned to pass only precursor ions of a pre-determined precursor-ion m/z ratio (Step 108), with the so-transmitted ions directed to a reaction cell. Optionally, the first mass analyzer may comprise an ion trap mass analyzer. In this case, the selected precursor ions of the pre determined precursor-ion m/z ratio may be first isolated (Step 106, indicated as being optional in FIG. 2 by a dashed box) in the first analyzer, such as by resonance ejection of other ions. The isolated ions are then directed (Step 108) to the reaction cell. The reaction cell may comprise a fragmentation cell or dissociation cell such as the dissociation cell 52 in FIGS. 1A-1B. In the dissociation cell, those ions undergo fragmentation and the products of dissociation are accumulated in the cell (Step 110) for a predetermined time required to collect a certain quantity of ions of interest. The predetermined time will vary according to the types of precursor and product ions that are being analyzed. In preferred embodiments, the ion source produces a continuous beam of ions and the first mass analyzer is a flow-through filtering device (such as, for instance, a quadrupole mass filter) such that Steps 104-110 proceed essentially simultaneously. After accumulating the product ions for the predetermined time, all reaction products are released from the dissociation cell and directed toward a second mass analyzer (e.g., mass analyzer 40 of FIG. 1A) in Step 112.

The second analyzer is tuned to pass ions of a selected product-ion in/z ratio (Step 112) to the detection system (e.g., detector 54) which detects the released product ions for a predetermined time period (Step 114) subsequent to the product ion release. The second mass analyzer may, in various embodiments, comprise, without limitation, a quadrupole mass filter, a linear ion trap mass analyzer, a quadrupole mass trap analyzer, an orbital trap or electrostatic trap analyzer, or a time-of-flight mass analyzer. The predetermined time period after the product-ion release may be based on or related to a predetermined delay time or wait time after which mass analysis and data acquisition commences. The same predetermined time period may also be based on or related to a time duration for mass analysis and data acquisition. If the second mass analyzer is a quadrupole mass filter, then the Steps 112 and 114 may occur substantially simultaneously, with the quadrupole mass filter acting as a pass through device that filters a beam of ions released from the reaction cell.

In step 116, the signal that is registered by the mass analyzer over the predetermined time period subsequent to product-ion release is electronically sent to a data processing unit (e.g., controller 44). The series of steps, Steps 110-116 may optionally be repeated for a variable number, n, of times so that the multiple data acquisition results may be averaged by the data processing unit. The number, n, may be fixed or may vary according to an expected duration of availability analyte ions introduced into the mass spectrometer (Step 102), perhaps in accordance with an expected elution period of the analyte. The repeated iteration of Steps 110-116 is most appropriate if precursor ions are being transmitted, perhaps continuously, to the reaction cell (Step 108) simultaneous with the execution of Steps 110-116.

The present method differs from conventional operation in that, in the present method, reaction-product ions are temporarily accumulated in the reaction cell 52. The exit lens 80 may be employed as a gate so as to temporarily block product ion egress and to periodically release the accumulated product ions. Because of this temporary accumulation of product ions of interest within the reaction cell, the ion current attributable to these product ions of interest is enhanced immediately after the release from the reaction cell, as compared to the background (or "noise") ion current which remains unchanged. By contrast, during conventional operation, the reaction cell 52 is employed as a simple flow-through device, with ions continuously entering through lens 53 and exiting through lens 80.

EXAMPLES

Proof of concept experiments were performed on a triple quadrupole instrument commercially provided by Thermo Fisher Scientific™ of Waltham, Mass. USA. For the purpose of demonstrating the signal increase, the removal pulse (the electrical signal that is ordinarily transmitted to the ion reaction cell 52 to effect ion release from the collision cell at the end of a conventional measurement period) was cancelled during the inter-scan time and the inter-scan time was set to be as long as one hundred milliseconds. In order to prevent cross talk and to confirm the validity and reproducibility of the accumulation effect, the accumulation and detection steps were repeated many times, with dummy transition-monitoring events introduced as necessary between such accumulation and detection steps.

All experimental results were obtained and processed in the following manner. Every data acquisition period after release of product ions from the reaction cell consisted of three segments with 0.1 ms settling time applied before every segment. The first segment was 1 ms long and was used to acquire a high level signal. The second segment was 30 ms long and used to demonstrate the relaxation of the high level signal to an equilibrium value. The third segment was 300 ms long and used to monitor the equilibrium or steady state intensity of selected product ions as would be obtained in a conventional SRM experiment performed using a triple-quadrupole apparatus. A 100 ms inter-scan time period followed the third segment. This 100 ins time length was chosen for the inter-scan period as it is currently used as a standard time for SRM acquisitions. The inter-scan period is the time during which product ions for a subsequent data acquisition period are accumulated in the fragmentation cell. Although an inter-scan time duration of 100 ms is desirable, this time period could be set to a longer duration in order to provide more time to accumulate a larger quantity of low abundance ions. Also, this long time period allowed more than enough time for the system to adjust to the new scan settings when necessary. Every experiment lasted for 1 minute and the illustrated spectra in the accompanying figures are averages of several accumulations over this 1 minute time. The collision pressure was set to 2 mTorr.

Figure 3A:
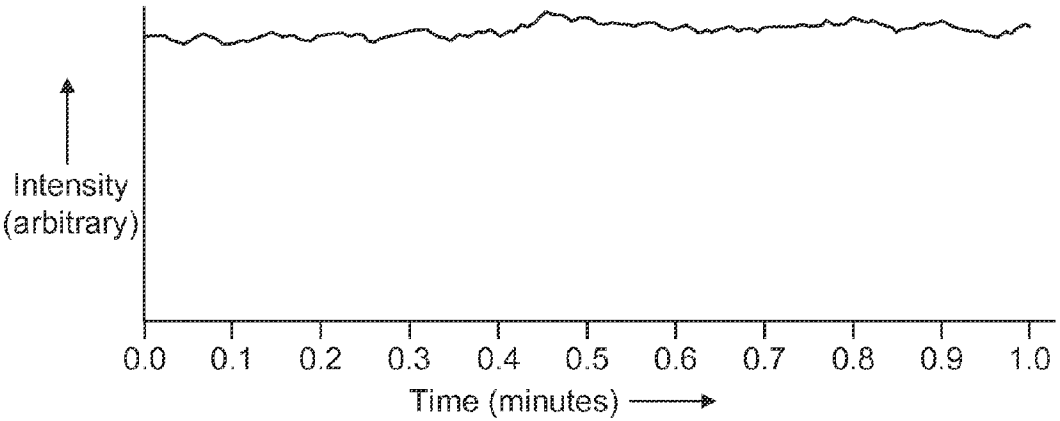
FIG. 3A is a total ion chromatogram obtained over the entire one-minute duration of the experiment and FIG. 3B is a set of plots of averaged detected signals corresponding to three data acquisition segments.
Figure 3B:
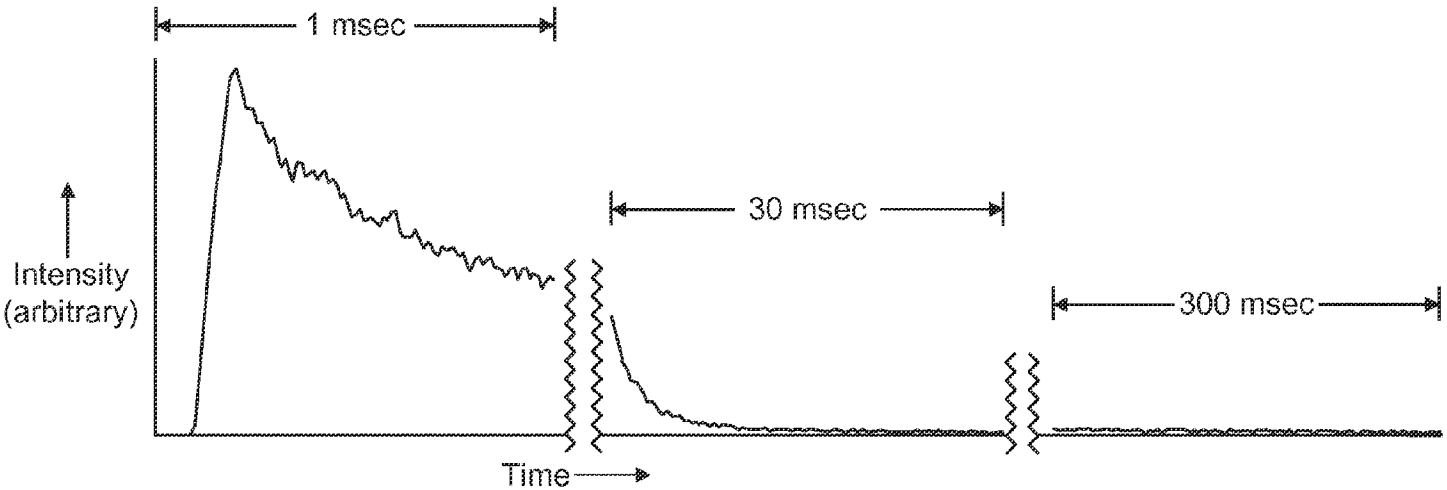
Figure 4A:
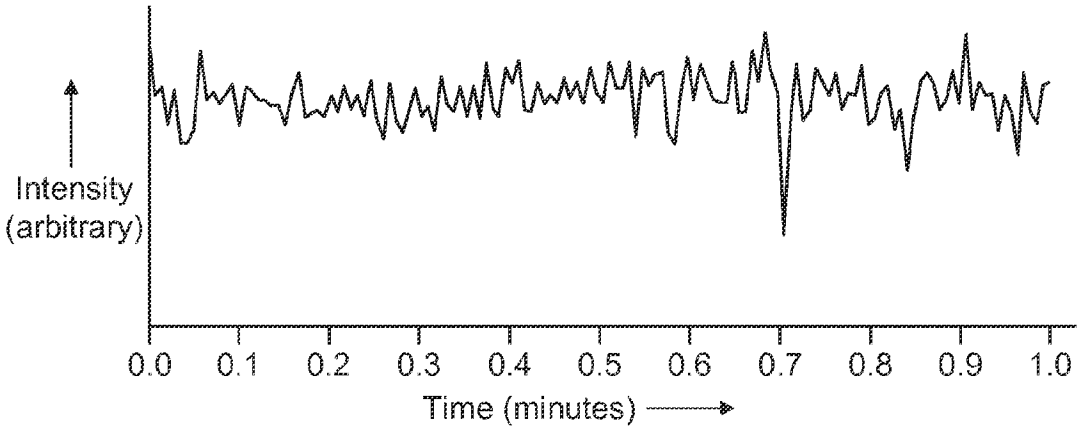
FIG. 4A is a total ion chromatogram obtained over the entire one-minute duration of the experiment and FIG. 4B is a set of plots of averaged detected signals corresponding to three data acquisition segments.
Figure 4B:
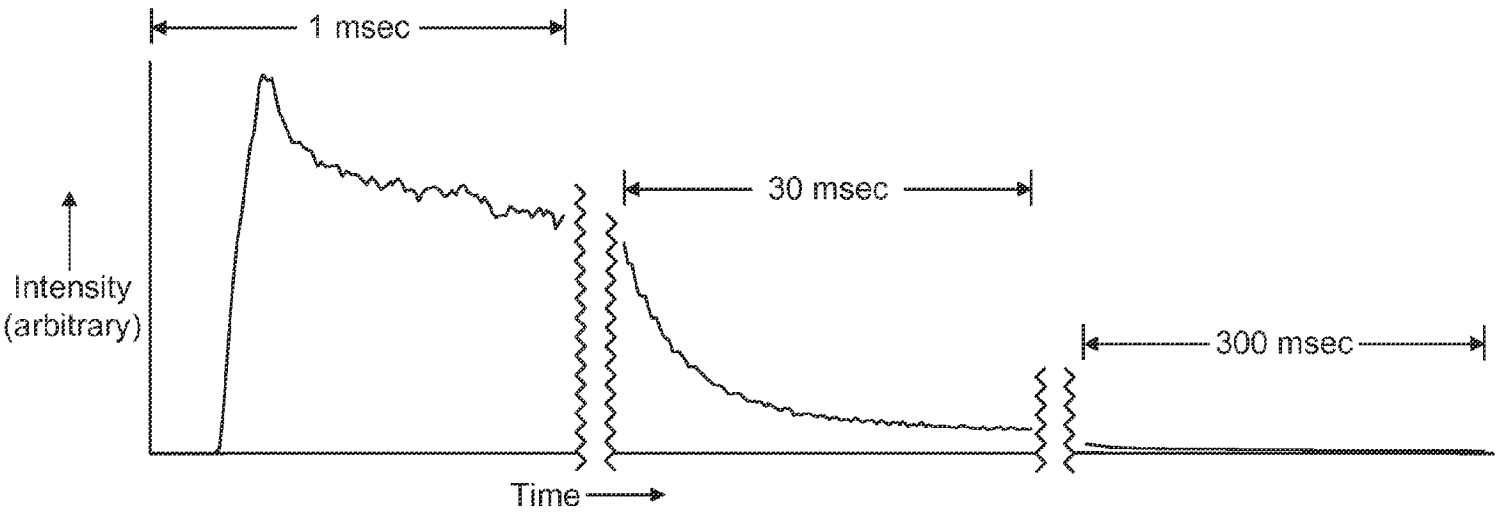

FIGS. 3A-3B and FIGS. 4A-4B show the signal increase for weak transitions acquired on a Polytyrosin 1,3,6 sample. FIGS. 3A-3B show the transition 182.1→119.1, obtained using a collision energy of 15 eV and FIGS. 4A-4B show the transition 997.3→445.3, obtained using a collision energy of 28 eV. FIGS. 3A and 4A show total ion chromatograms obtained over the entire one-minute experiments; FIGS. 3B and 4B illustrate the averaged detected signals corresponding to the three data acquisition segments described above. The signal increase can be quantified by introducing the Signal Increase Ratio, R. The Signal Increase Ratio, R, is calculated as the ratio of the mean ion current for the first segment (i.e., the 1 ins segment) to the mean ion current for segment three (i.e., the 100 ms segment), averaged over the duration of the experiment. In the experiment shown on FIG. 3B the Signal Increase Ratio reached R=70, and in the experiment shown on FIG. 4B the Signal Increase Ratio reached R=400.

The results of these measurements confirm that the maximum intensity of the accumulated signal is roughly proportional to the accumulation time and the precursor mass. This implies that quantitative analysis for the precursor ion may be conducted using appropriate calibration routines. A feature of the observed results is that the signal of high intensity lasts for a very short time (e.g., one to several milliseconds) after the reaction product release event. Let us call this time period as $T_{decay}$ and let us call the normal conventional data acquisition time as $T_{norm}$. Provided that $T_{decay}<T_{norm}$ the method can, in some instances, use a portion of the overhead time, $T_{pst}$, for accumulation of product ions within the reaction cell so as to achieve the beneficial increase of duty cycle and/or acquisition rate.

In some instances, space charge effects within the reaction cell may comprise a limiting actor for the method. In an experiment in which one of the most abundant fragments was accumulated, the inventors observed that it was not possible to reach the detector saturation level at any of accumulation times ranging from 100 ms to 2500 ms. These results suggest that, in this instance, the limit imposed by space charge effects was reached in the collision cell. This suggestion is supported by the shape of the acquired profiles: at accumulation times longer than some threshold value the profiles become irregularly disrupted with each acquisition. Fortunately, the observed level of saturation attributable to the space charge effect leaves several orders of magnitude for amplification of signals of interest and thus imposes no practical limitations for weak signals.

In some cases, a limit for amplification of weak product-ion signals may be reached as a result of a limited mean lifetime of the product ions within the reaction cell. Such an ion lifetime factor may be related either to the physical/chemical properties of the specific ion or to the trapping/confinement quality of a reaction cell. In the latter case, the lifetime effect may be countered by employing a dissociation cell which has improved ion confinement properties. In the former case, the limitation may result from competition between the processes of creation of specific fragment and processes leading to further dissociation of initially-formed fragments into even smaller fragments. The initially-formed fragment ions may not be observable using conventional SRM techniques. It may be expected that the kinetics of the competing processes will lead to ion-specific best or optimal accumulation times for limited-lifetime ions. The best or optimal accumulation time, for purposes of initiating the release of accumulated product ions from the reaction cell or fragmentation cell, would be expected to occur at a time at which a steady-state situation occurs such that the rate of destruction of a product ion by continued fragmentation or fragmentation within the cell just becomes equal to its rate of generation by reaction or fragmentation of selected precursor ions within the cell. Calibration procedures may be employed to determine the best or optimal accumulation times.

There may be also a limitation for weak signals caused by the fringe field at the entrance side of the dissociation cell. This is supported by experimental results obtained in positive ion mode for very low-abundance fragment ions. In the experiment noticeable results were obtained only when applying a negative potential (−50 V) to both electrodes at both ends of the reaction cell, even though these electrodes are intended for creation of an axial drag field within the reaction cell. Even though the axial drag field was zero in this case, the negative potential at the front end worked as a correcting lens for fringe field. At the same time the axial field itself had no substantial effect on the accumulation effect. For strong signals the axial field did not affect the signal noticeably: for weak signals the axial field could make accumulated ion pulse few hundred millisecond wider while roughly preserving the pulse area.

Figure 5:
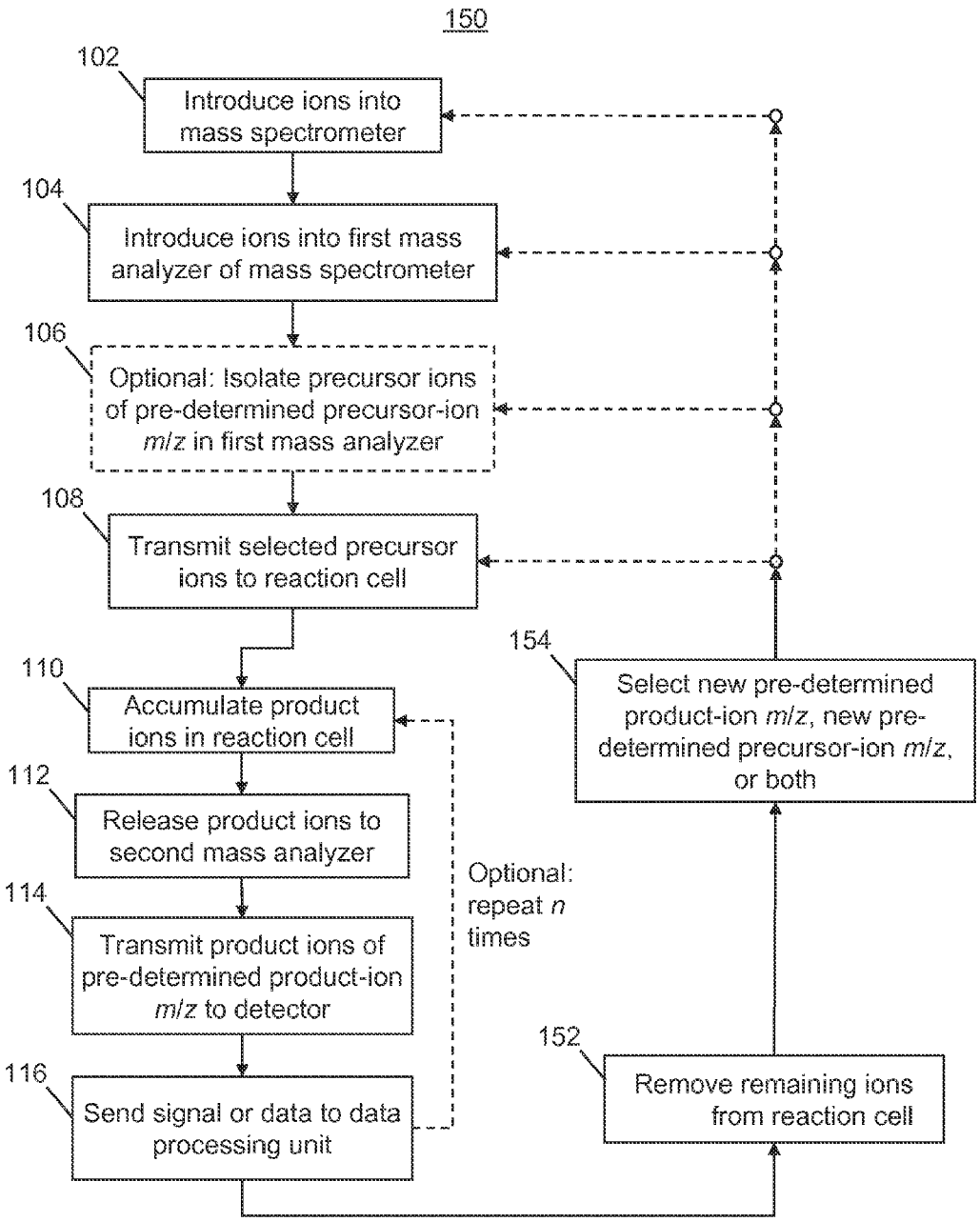
FIG. 5 is a flow diagram of a second method in accordance with the present teachings.

FIG. 5 is a flow diagram of a second method, method 150, in accordance with the principles of the present teachings and illustrates the measurement of multiple transitions. Steps 102-116 of the method 150 shown in FIG. 5 are identical to the similarly numbered steps of the method 100 shown in FIG. 2 and previously described. Steps 15 and 154 are also included in method 150 and occur after the measurement or monitoring of a first ion transition as discussed with reference to FIG. 2. In Step 152, any ions remaining from the prior measurement—such as un-reacted precursor ions or fragment ions of any type—are removed from the reaction cell no as to avoid interference with subsequent measurements. In control software or firmware, this ion removal may be accomplished by simply inserting "dummy" transitions into a list of transitions to be measured. During such dummy-transition measurements, ions are not delivered to the reaction cell but the front and rear lenses undergo their normal event sequences in the same fashion as if an actual experiment were being performed. In step 154, new values for product-ion m/z, precursor-ion in/z, or both product-ion and precursor-ion m/z are selected, perhaps by an instrument user.

Subsequent to execution of Step 154, a sequence of steps chosen from the Steps 102-116 is executed as with the previous ion transition measurement, but using the new m/z values selected in Step 154. The various alternative execution pathways are indicated with dashed arrows in FIG. 5. Depending on the configuration of the apparatus on which the method is implemented, one or more of the Steps 102, 104 and 106 may be executed after execution of Step 154. For example, in some instruments, ions may be continuously introduced—as a continuous flow or beam—from an ion source into the mass spectrometer (Step 102) and, possibly, into the first mass analyzer (Step 104). In such instances, ions for a measurement may already be available, having been introduced, for instance, simultaneously with a prior execution of one or more of Steps 112-154. Thus, one or more of Steps 102-104 may be bypassed under certain conditions. Also, as previously noted, Step 106 may be executed only in conjunction with specific configurations of the first mass analyzer.

Figure 6A:
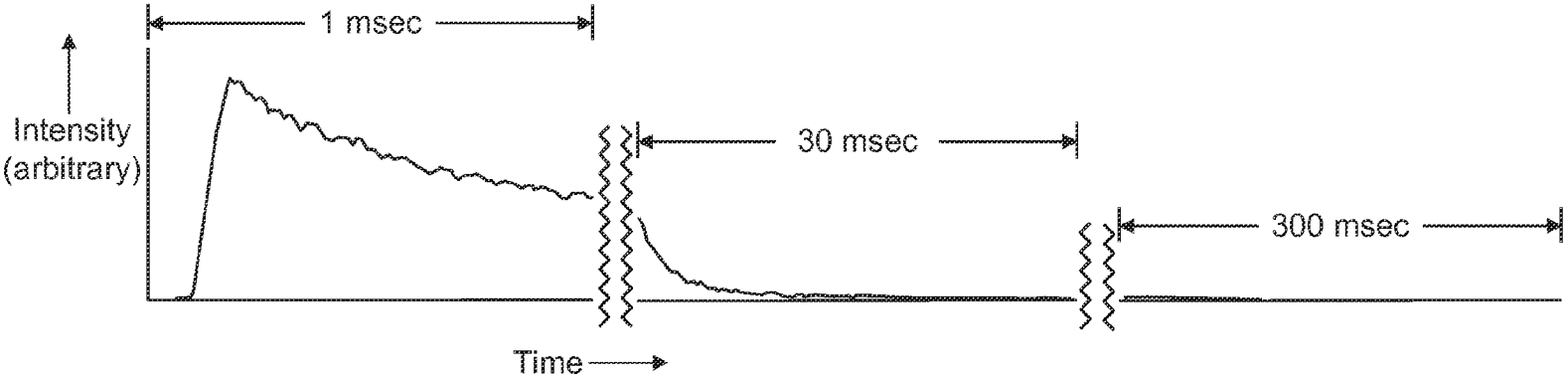
FIG. 6A is a plot of results of experimental monitoring of the 182.1→119.1 transition of Polytyrosin 1,3,6
Figure 6B:
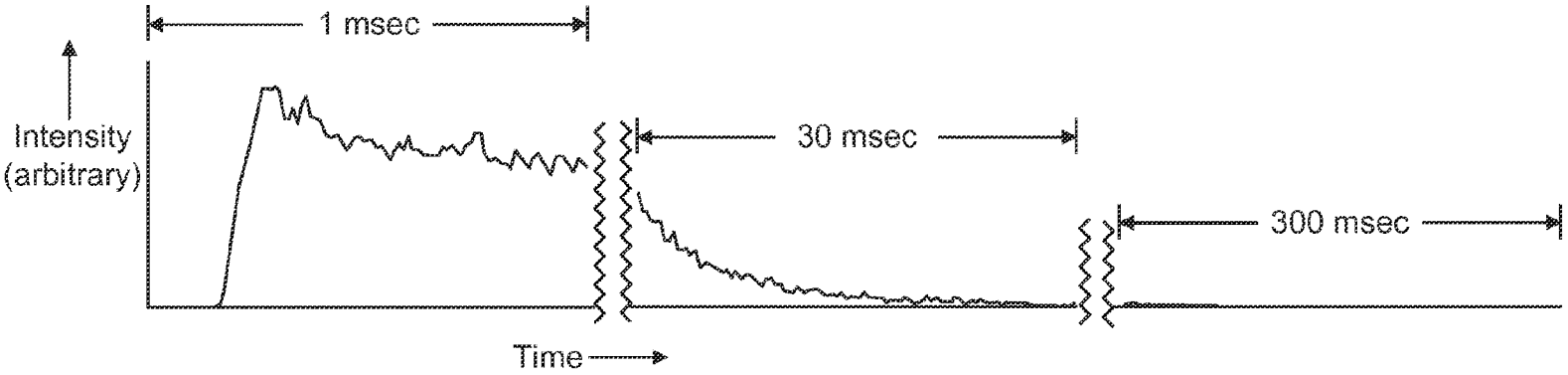
FIG. 6B is a plot of results of experimental monitoring of the 997.3→445.3 ion transition of Polytyrosin 1,3,6, where the two sets of measurements were obtained using same infused sample and where a dummy transition was inserted between the two sets of measurements.

FIGS. 6A-6B illustrate measured results obtained using the method 150. FIG. 6A illustrates measurement of the 182.1→119.1 transition of polytyrosin 1,3,6 (cf. FIGS. 3A-3B) and FIG. 6B illustrates measurement of the 997.3→445.3 transition (cf. FIGS. 4A-4B). Both sets of measurements were obtained from the same sample infusion, with the measurements of these real transitions separated by a dummy transition. The measurement of the intermediate dummy transition (not shown) was featureless thus indicating the applicability of the method.

Figure 7A:
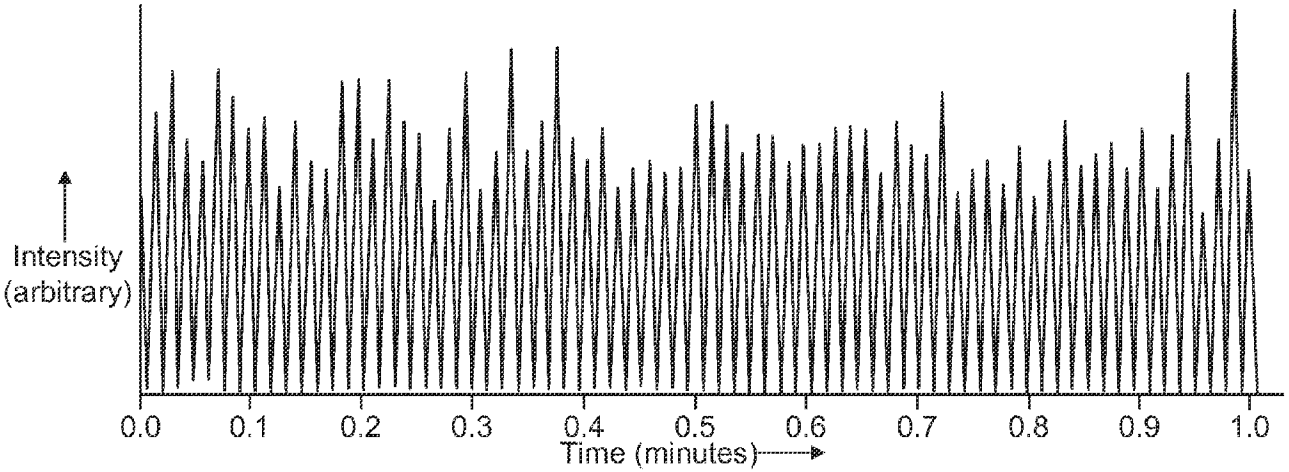
FIG. 7A is a total ion chromatogram obtained over the entire one-minute duration of the experiment and FIG. 7B is a set of plots of averaged detected signals corresponding to three data acquisition segments.
Figure 7B:
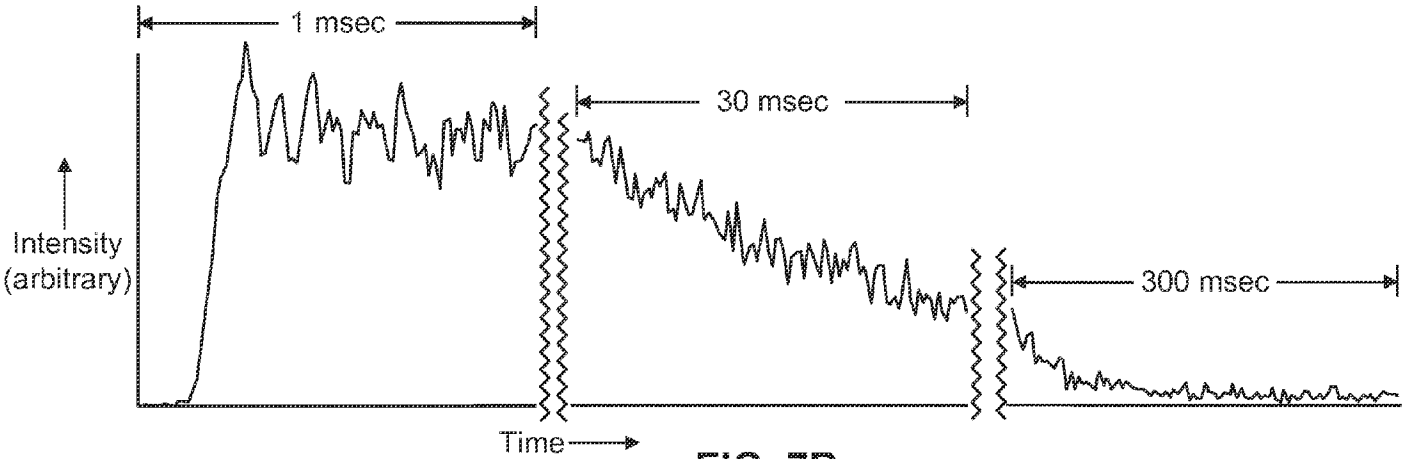
Figure 8A:
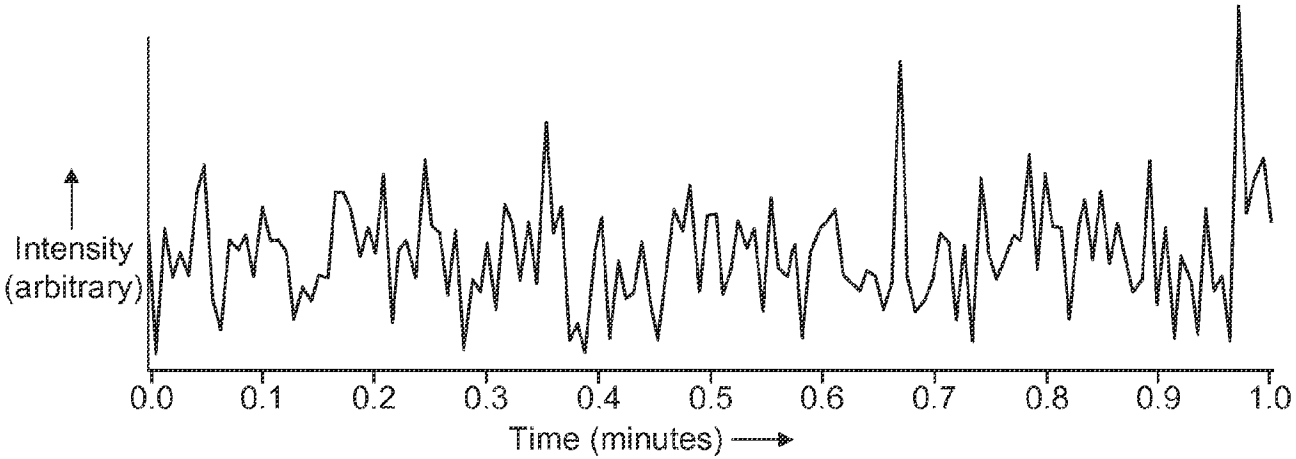
FIG. 8A is a total ion chromatogram obtained over the entire one-minute duration of the experiment and FIG. 8B is a set of plots of averaged detected signals corresponding to three data acquisition segments.
Figure 8B:
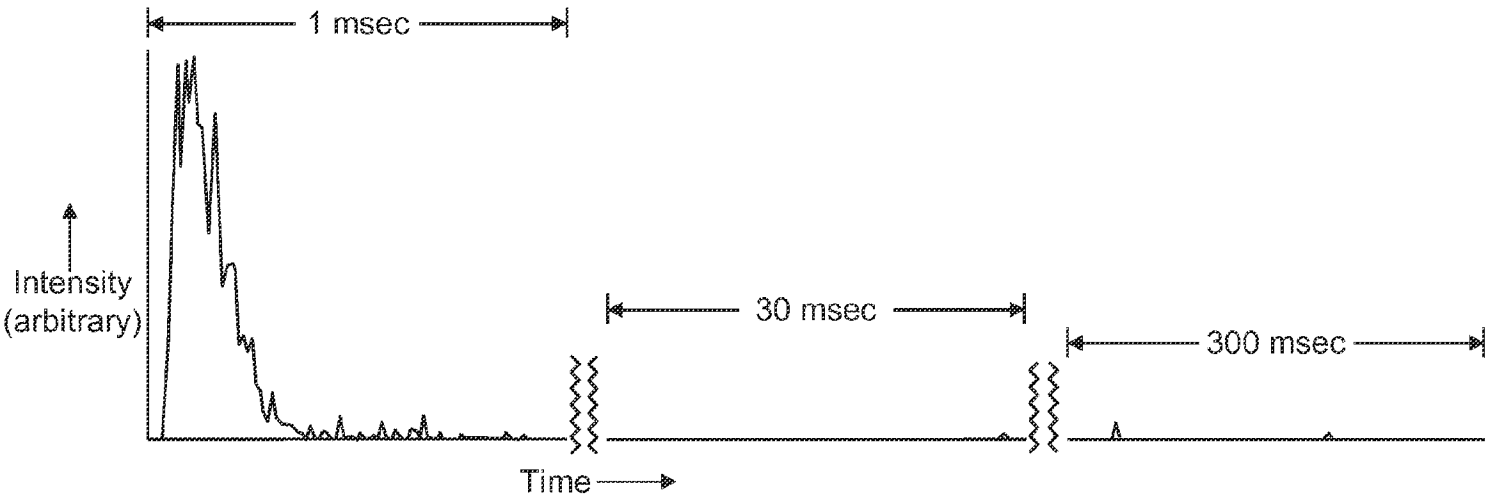

FIGS. 7A-7B show results of alprazolam infusion at 2 μL/min at a concentration of 100 fg/μL. Such infusion yields an analyte flux comparable with the one found during experiment with injection of 10 fg of alprazolam on column. Such amount of analyte is only 20 times higher than the limit of detection for the given unmodified instrument. In this example, the transition 309.2→281.1 was monitored. The spectrum shows 43-fold increase of accumulated signal as compared with the equilibrium one. Every real transition was followed by a dummy one to confirm the effect of accumulation. FIGS. 8A-8B demonstrate the amplification effect for an "invisible" product ion whose presence would not be recognized using conventional methods. In this example, the alprazolam sample at the concentration of 0.3 fg/pt was infused at the rate 2 μL/min and the transition 309.2→281.1 was monitored. The estimate for an on column injection equals to 0.03 fg/on column which is about 16 times less than the limit of detection. FIG. 8B shows an improved signal only in the first segment as a result of the accumulation effect. The absence of a signal (that is, noise spikes only) in the second and third segments confirms that the analyte at the given concentration is not detectable by the conventional approach.

CONCLUSION

Improved methods of mass spectrometry have been disclosed. Methods in accordance with the present teachings are useful in detecting and quantifying analytes in samples using weakly-observed ion transitions (such as cases in which the analytes are present in very low abundance) and can especially improve the lowermost detection limits and quantification limits of such low-abundance analytes as measured by beam instruments, such as triple-quadrupole mass spectrometers. The principal differences between the instant methods and conventional approaches using ion storage and ion pulsing approach consists of the following: i) there is no pulsing of source ions: as continuous flow of ions to the dissociation cell is not changed; ii) reaction product ions are manipulated, not source ions; iii) measurement benefits are achieved by measuring of product ion current during the first short period (1 to several, milliseconds or less) after an ion release event; iv) measurements are able to account for ions that were usually lost or discarded in the previous art.

Other benefits of the instant teachings may include but are not necessarily limited to: 1) reaching better limit of detection; 2) achieving better limit of quantitation; 3) achieving better limits of relative standard deviation (RSD) for low-concentration samples; 4) increase of SRM rate (by reducing acquisition time to up to sub-millisecond level) for samples which contain abundant ions; 5) using less amount of sample while similar-quality data; 6) increased dynamic range; and 7) higher sample throughput. The methods in accordance with the present teachings may be employed in conjunction with the use of any one of the various fragmentation or reactions cell configurations illustrated in FIGS. 1B, 1E and 1F or with any variations or combinations thereof that would be readily understood by one of ordinary skill in the art. The methods in accordance with the present teachings are particularly advantageous when employed in conjunction with the use of a triple-quadrupole mass spectrometer.

The discussion included in this application is intended to serve as a basic description. Although the present invention has been described in accordance with the various embodiments shown and described, one of ordinary skill in the art will readily recognize that there could be variations to the embodiments and those variations would be within the scope of the present invention. The reader should be aware that the specific discussion may not explicitly describe all embodiments possible; many alternatives are implicit. Accordingly, many modifications may be made by one of ordinary skill in the art without departing from the scope of the invention. Neither the description nor the terminology is intended to limit the scope of the invention the invention is defined only by the claims. Any patents, patent publications or other publications mentioned herein are hereby incorporated by reference in their respective entireties.

What is claimed is:

1. A method for operating a mass spectrometer comprising:

(a1) introducing a first portion of a sample of ions into a first mass analyzer of the mass spectrometer, the sample including precursor ions comprising a first precursor-ion mass-to-charge (m/z) ratio;

(b1) transmitting the precursor ions comprising the first precursor-ion m/z ratio from the first mass analyzer into an elongate trapping volume of a reaction or fragmentation cell of the mass spectrometer through an entrance end thereof such that a first population of product ions generated within the fragmentation or reaction cell from the precursor ions are continuously accumulated within the elongate trapping volume over a first accumulation time period, wherein the reaction or fragmentation cell further comprises an exit end and wherein the fragmentation or reaction cell includes a single set of electrodes, the single set of electrodes consisting essentially of a set of multipole rods disposed parallel to the elongate trapping volume, a first electrostatic lens disposed at the entrance and a second electrostatic lens disposed at the exit end;

(c1) initiating release of the accumulated first population of product ions from the reaction or fragmentation cell through the exit end;

(d1) continuously transmitting the released first population of product ions from the reaction cell to a second mass analyzer of the mass spectrometer;

(e1) transmitting a portion of the released first population of product ions from the second mass analyzer to a detector of the mass spectrometer, said portion comprising a first product-ion m/z ratio; and (f1) detecting a varying quantity of the portion of the released first population of product ions having the first product-ion m/z ratio with the detector for a predetermined data-acquisition time period after the initiation of the release of the accumulated first population of product ions, wherein a duration of the first accumulation time period is chosen such that the initiation of the release of the accumulated first population of product ions from the reaction or fragmentation cell encompasses a time during which a rate of destruction of product ions comprising the first product-ion m/z ratio within the reaction or fragmentation cell is equal to the rate of generation of the product ions comprising the first product-ion m/z ratio within the reaction or fragmentation cell.

2. A method for operating a mass spectrometer as recited in claim 1, wherein the transmitting of the precursor ions comprising the first precursor-ion m/z ratio from the first mass analyzer into the elongate trapping volume of the reaction or fragmentation cell comprises continuously transmitting the precursor ions comprising the first precursor-ion m/z ratio from a quadrupole mass filter into the elongate trapping volume of the reaction or fragmentation cell.

3. A method for operating a mass spectrometer as recited in claim 2, wherein the transmitting of the portion of the released first population of product ions from the second mass analyzer to the detector comprises continuously transmitting the portion of the released first population of product ions from a quadrupole mass filter to the detector.

4. A method for operating a mass spectrometer as recited in claim 3, wherein the transmitting of the precursor ions comprising the first precursor-ion m/z ratio from the first mass analyzer into the elongate trapping volume of the reaction or fragmentation cell comprises transmitting the precursor ions comprising the first precursor-ion m/z ratio from the first mass analyzer into an elongate trapping volume of a quadrupole reaction or fragmentation cell.

5. A method for operating a mass spectrometer as recited in claim 1, wherein the transmitting of the portion of the released first population of product ions from the second mass analyzer to the detector comprises continuously transmitting the portion of the released first population of product ions from a quadrupole mass filter to the detector.

6. A method for operating a mass spectrometer as recited in claim 1, further comprising:

(a2) introducing a second portion of the sample of ions into the first mass analyzer, said second portion including additional precursor ions comprising the first precursor-ion m/z ratio;

(b2) transmitting the additional precursor ions comprising the first precursor-ion m/z ratio, from the first mass analyzer into the elongate trapping volume of the reaction or fragmentation cell through the entrance end such that a second population of product ions generated within the fragmentation or reaction cell from the additional precursor ions are continuously accumulated within the elongate trapping volume over a second accumulation time period, wherein a duration of the second accumulation time period is equal to the duration of the first accumulation time period;

(c2) initiating release of the accumulated second population of product ions from the reaction or fragmentation cell through the exit end;

(d2) continuously transmitting the released second population of product ions from the reaction cell to the second mass analyzer;

(e2) transmitting a portion of the released second population of product ions from the second mass analyzer to the detector, said portion comprising the first product-ion m/z ratio;

(f2) detecting a varying quantity of the portion of the released second population of product ions having the first product-ion m/z ratio with the detector for the predetermined data-acquisition time period after the initiation of the release of the accumulated second population of product ions; and adding together or averaging the detected varying quantities of the portion of the released first and second populations of product ions.

7. A method for operating a mass spectrometer as recited in claim 6, wherein steps (a2) and (b2) are performed simultaneously with the performing of one or more of steps (d1), (e1) and (f1), and the step (c2) is performed after the performing of steps (d1), (e1) and (f1).

8. A method for operating a mass spectrometer as recited in claim 1, further comprising:

calculating a single integrated quantity comprising an integration or summation over time of the detected varying quantity of the portion of the released first population of product ions having the first product-ion m/z ratio; and calculating, from the single integrated quantity, a concentration or amount of an analyte compound in a sample from which the first portion of the sample of ions was derived.

9. A method for operating a mass spectrometer comprising:

(a1) introducing a first portion of a sample of ions into a first mass analyzer of the mass spectrometer, the sample including precursor ions comprising a first precursor-ion mass-to-charge (m/z) ratio;

(b1) transmitting the precursor ions comprising the first precursor-ion m/z ratio from the first mass analyzer into a reaction or fragmentation cell of the mass spectrometer through an entrance end thereof such that a first population of product ions generated within the fragmentation or reaction cell from the precursor ions are continuously accumulated within an elongate trapping volume thereof over a first accumulation time period;

(c1) initiating release of the accumulated first population of product ions from the reaction or fragmentation cell through an exit end thereof, wherein the entrance and exit ends are disposed at opposite ends of the elongate trapping volume;

(d1) continuously transmitting the released first population of product ions from the reaction cell to a second mass analyzer of the mass spectrometer;

(e1) transmitting a portion of the released first population of product ions from the second mass analyzer to a detector of the mass spectrometer, said portion comprising a first product-ion m/z ratio; and (f1) detecting a varying quantity of the portion of the released first population of product ions having the first product-ion m/z ratio with the detector for a predetermined data-acquisition time period after the initiation of the release of the accumulated first population of product ions wherein a duration of the first accumulation time period is chosen such that the initiation of the release of the accumulated first population of product ions from the reaction or fragmentation cell encompasses a time during which a rate of destruction of product ions comprising the first product-ion m/z ratio within the reaction or fragmentation cell is equal to the rate of generation of the product ions comprising the first product-ion m/z ratio within the reaction or fragmentation cell.

* * * * *